US006651723B1

(12) United States Patent
Cloutier

(10) Patent No.: US 6,651,723 B1
(45) Date of Patent: Nov. 25, 2003

(54) GARAGE DOOR OPENING/CLOSING SYSTEM

(76) Inventor: Hermel Cloutier, 55 Penton Dr., Barrie, On (CA), L4N 7A2

( * ) Notice: Subject to any disclaimer, the term of this patent is extended or adjusted under 35 U.S.C. 154(b) by 0 days.

(21) Appl. No.: 09/958,331

(22) PCT Filed: Apr. 10, 2000

(86) PCT No.: PCT/CA00/00374

§ 371 (c)(1),
(2), (4) Date: Oct. 9, 2001

(87) PCT Pub. No.: WO00/61904

PCT Pub. Date: Oct. 19, 2000

(30) Foreign Application Priority Data

Apr. 8, 1999 (CA) ..... 2268692

(51) Int. Cl.[7] ..... E05D 15/06

(52) U.S. Cl. ..... 160/201; 160/33; 160/182; 160/202; 49/200

(58) Field of Search ..... 160/33, 35, 36, 160/189, 201, 202; 49/139, 199, 200

(56) References Cited

U.S. PATENT DOCUMENTS

| | | | | |
|---|---|---|---|---|
| 1,954,813 A | | 4/1934 | Harris | |
| 2,747,864 A | | 5/1956 | Miller | |
| 2,909,178 A | | 10/1959 | Lawick | |
| 3,353,299 A | | 11/1967 | Castonguay | |
| 3,478,469 A | | 11/1969 | Estes | |
| 3,633,313 A | | 1/1972 | Lafontaine | |
| 4,367,470 A | * | 1/1983 | Tadokoro et al. | 340/825.77 |
| 4,397,117 A | * | 8/1983 | Shipp | 49/501 |
| 4,460,030 A | * | 7/1984 | Tsunemura et al. | 160/35 |
| 4,472,910 A | | 9/1984 | Iha | |
| 4,610,119 A | * | 9/1986 | Bench, Sr. | 52/309 |
| 4,878,529 A | * | 11/1989 | Hormann | 160/201 |
| 5,010,688 A | * | 4/1991 | Dombrowski et al. | 49/362 |
| 5,664,372 A | * | 9/1997 | Williams et al. | 49/362 |
| 5,857,510 A | * | 1/1999 | Krupke et al. | 160/201 |
| 6,029,411 A | * | 2/2000 | Richardson | 52/204.51 |
| 6,041,845 A | * | 3/2000 | Couch | 160/201 |
| 6,073,674 A | * | 6/2000 | Hormann | 160/201 |
| 6,227,281 B1 | * | 5/2001 | Martin | 160/201 |
| 6,401,793 B1 | * | 6/2002 | Martin | 160/191 |

FOREIGN PATENT DOCUMENTS

| | | | |
|---|---|---|---|
| DE | 19709931 | * 11/1997 | 160/201 X |
| EP | 0338750 | 10/1989 | |
| FR | 2726855 | 5/1996 | |

* cited by examiner

*Primary Examiner*—Bruce A. Lev
(74) *Attorney, Agent, or Firm*—Steptoe & Johnson LLP; D. Douglas Price

(57) ABSTRACT

There is provided a new and useful garage door (12) opening/closing system (10) comprising a garage door (12) having top (32), bottom (34), and first and second sides (54, 56) and having a series of rollers (58) associated with the first and second sides (54, 56); a pair of door rails (14, 16) at the first and second sides (54, 56) of the door (12) for receiving the rollers (58) for movement of the door along the rails (14, 16), in a door opening path; at least one hinge part mounted on the door intermediate the first and second ends (54, 56); a central guide rail (18) extending outwardly from the plane of a closed position of the door (12) from a position above the top (32) of the door (12); a trolley (20) mounted on the central guide rail (18) for movement along the guide rail, the trolley (20) for operative connection to at least one hinge part; at least one cable drum (22) having a pair of cables (26, 28) thereon operatively associated with the trolley for moving the trolley (20) along the central guide rail (18); and operator means operatively associated with at least one drum for driving at least one drum.

13 Claims, 7 Drawing Sheets

GARAGE DOOR OPENING/CLOSING SYSTEM

FIELD OF THE INVENTION

This application relates to an improved system for opening and closing garage doors.

BACKGROUND OF THE INVENTION

All systems which are currently known to the inventor to be in use for opening and closing garage doors, particularly in the commercial context, rely on springs and/or counter weights to balance the door. There are a great many disadvantages to such current systems. Many of these pertain to very substantial maintenance costs. These include spring breakage, cable stretch and drum slippage on the spring and counter weight systems, the imposition of a constant force on the garage door components, the upward bowing of the ends of the door, and the weight of the components. Ongoing maintenance includes frequent lubrication and other associated and time consuming maintenance.

A significant disadvantage to current systems is that they require substantial headroom above the door opening itself. Where a limited ceiling height is available, this obviously limits the permissible height of the door opening and thus the height of vehicles that can use the garage.

As well, current systems have a relatively low cycle life in the commercial context.

The safety factor of current installations is also relatively low.

It is against the above background that the present invention arises.

PRIOR ART

Applicant is aware of the following. U.S. patents which pertain to current garage door opening and closing systems:

U.S. Pat. No. 1,954,813, Harris, Apr. 17, 1934

U.S. Pat. No. 2,747,864, Miller, May 29, 1956

U.S. Pat. No. 2,909,178, Lawick, Oct. 20, 1959

U.S. Pat. No. 3,353,299, Castonguay, Nov. 21, 1967

U.S. Pat. No. 3,478,469, Estes, Nov. 18, 1969

U.S. Pat. No. 3,633,313, Lafontaine, Jan. 11, 1972

In addition, French Patent FR-A-2 726 855 teaches a garage door opening/closing system comprising a garage door having top, bottom, first and second sides and having a series of rollers associated with the first and second sides. A pair of door rails at the first and second sides of the door for receiving the rollers for movement of the door along the rails in a door opening path is discussed. There is also provided a central guide rail extending outwardly from the plane of a closed position of the door from a position above the top of the door and a trolley mounted on the central guide rail for movement along the guide rail. At least one member for hinge connection between the door and the trolley is provided wherein the member is extending from a midpoint of the top of the door perpendicular to the top of the door along the service of the door. The reference further requires two sets of counterweights required to balance the door in order to enable it to function. The counterweights form an integral part of the teaching of that reference and the arrangement for lifting the door would have little chance of operating in the absence of those counterweights.

BRIEF SUMMARY OF THE INVENTION

The invention provides a garage door opening/closing system comprising a garage door having top, bottom and first and second sides and having a series of rollers associated with the first and second sides; a pair of door rails at the first and second sides of the door for receiving the rollers for movement the door along the rails, in a door opening path; at least one hinge part mounted on the door intermediate the first and second ends; a central guide rail extending outwardly from the plane of a closed position of the door from a position above the top of the door; a trolley mounted on the central guide rail for movement along the guide rail, the trolley for operative connection to at least one hinge part; at least one cable drum having a pair of cables thereon operatively associated with the trolley for moving the trolley along the central guide rail; and operator means operatively associated with at least one drum for driving at least one drum.

BRIEF DESCRIPTION OF THE DRAWINGS

In drawings which illustrate embodiments of the invention.

Figure 1:
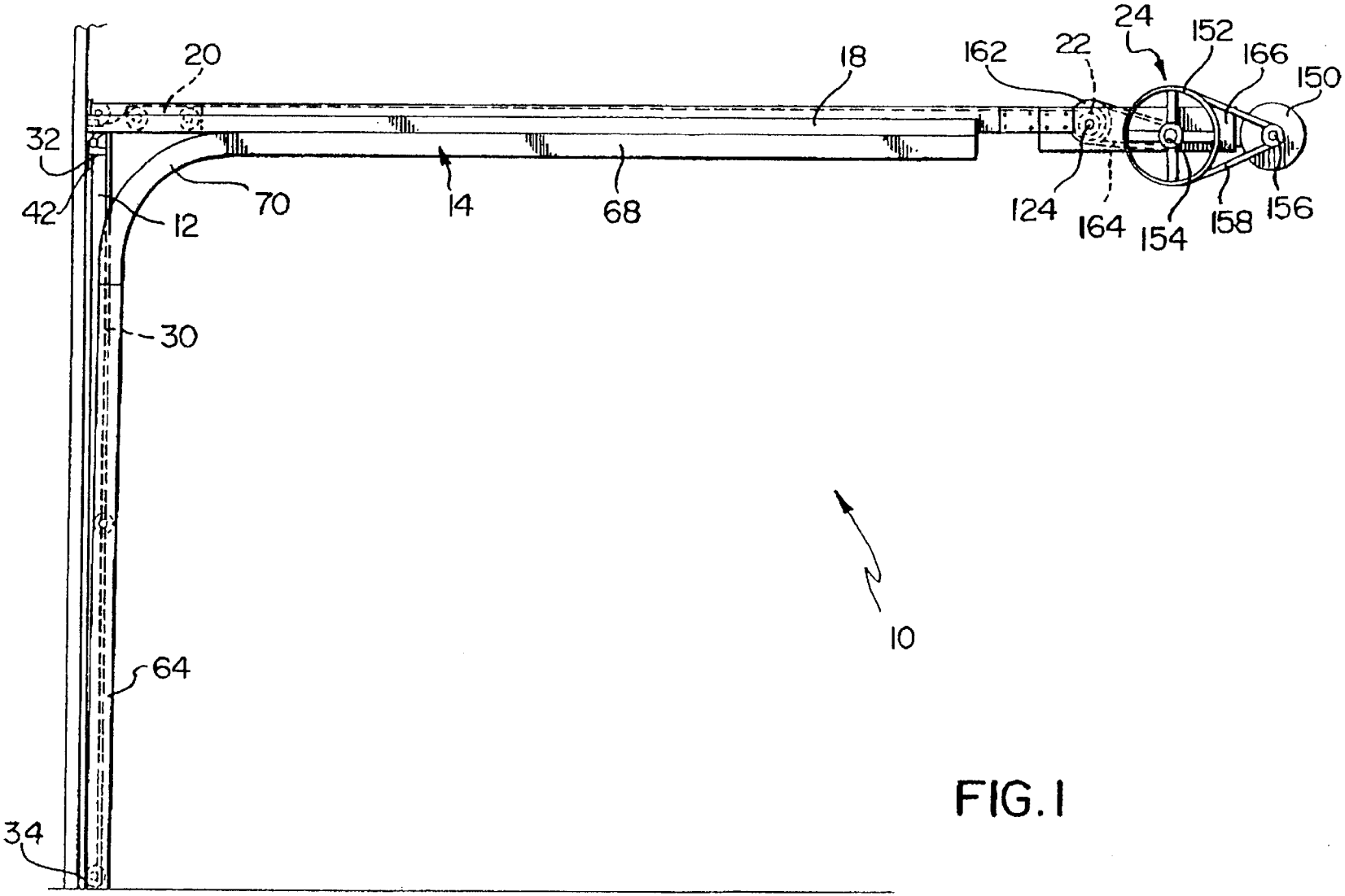
FIG. 1 is a side elevation partly in section of a system according to the invention.
Figure 2:
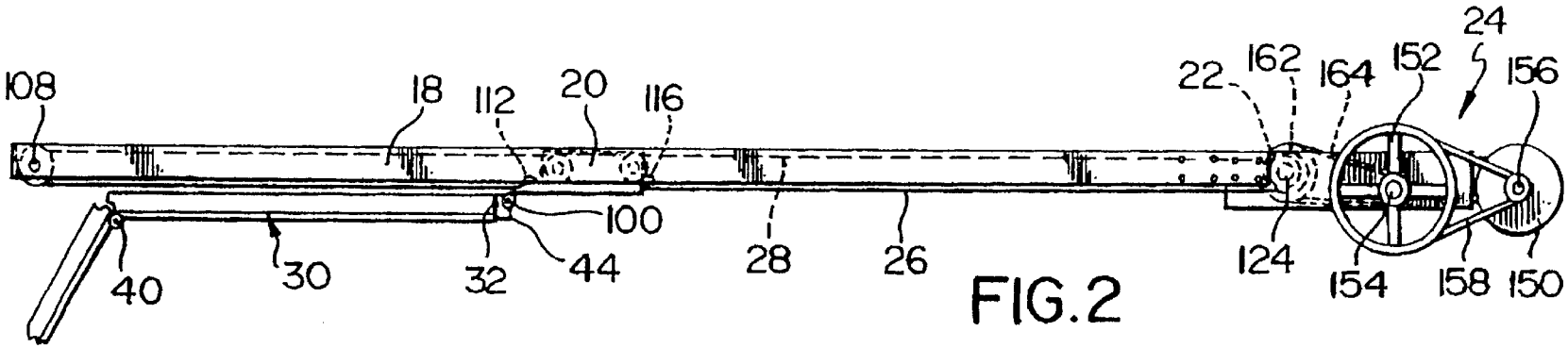
FIG. 2 is a side elevation of a part of the system of FIG. 1.
Figure 3:
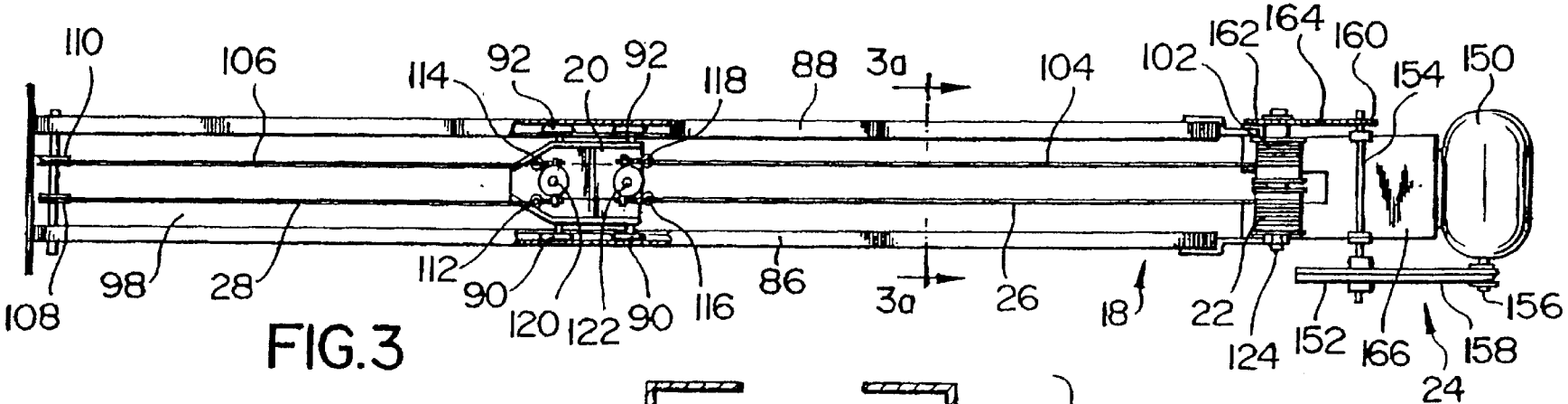
FIG. 3 is a top plan view of the drive assembly for the system of FIG. 1.
Figure 3A:
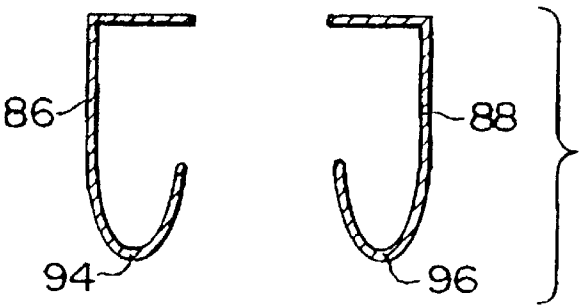
FIG. 3*a* shows detail of a part of the assembly of FIG. 3.
Figure 5:
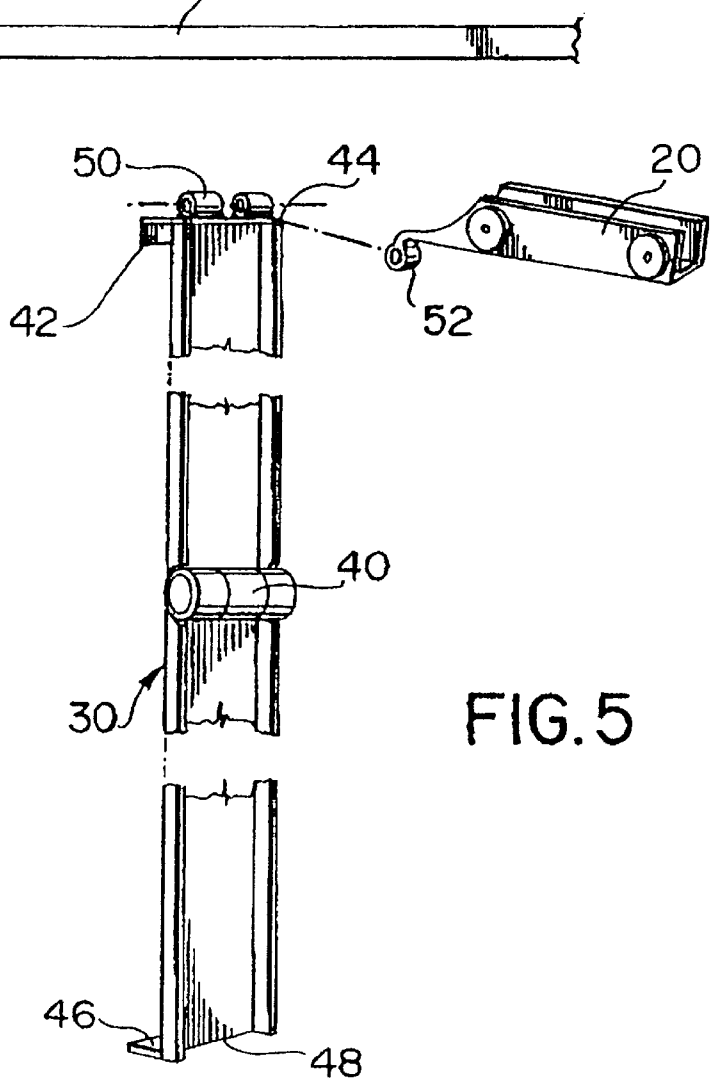
FIG. 5 illustrates greater detail of the FIG. 4 drawing.
Figure 4:
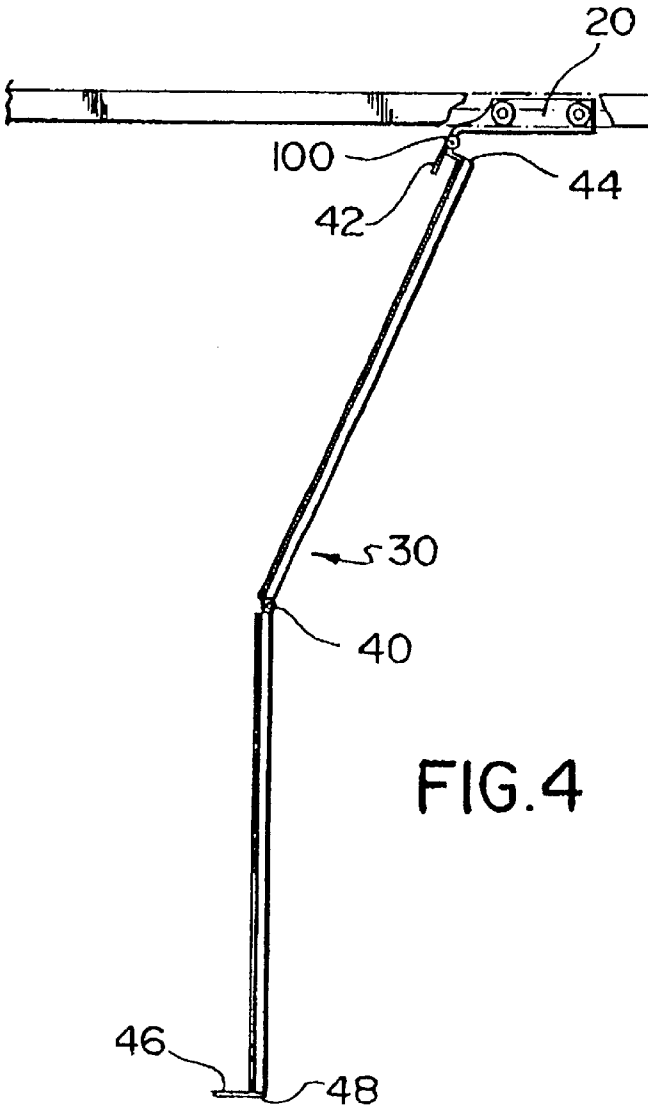
FIG. 4 illustrates detail of a part of the system of FIG. 1.
Figure 6:
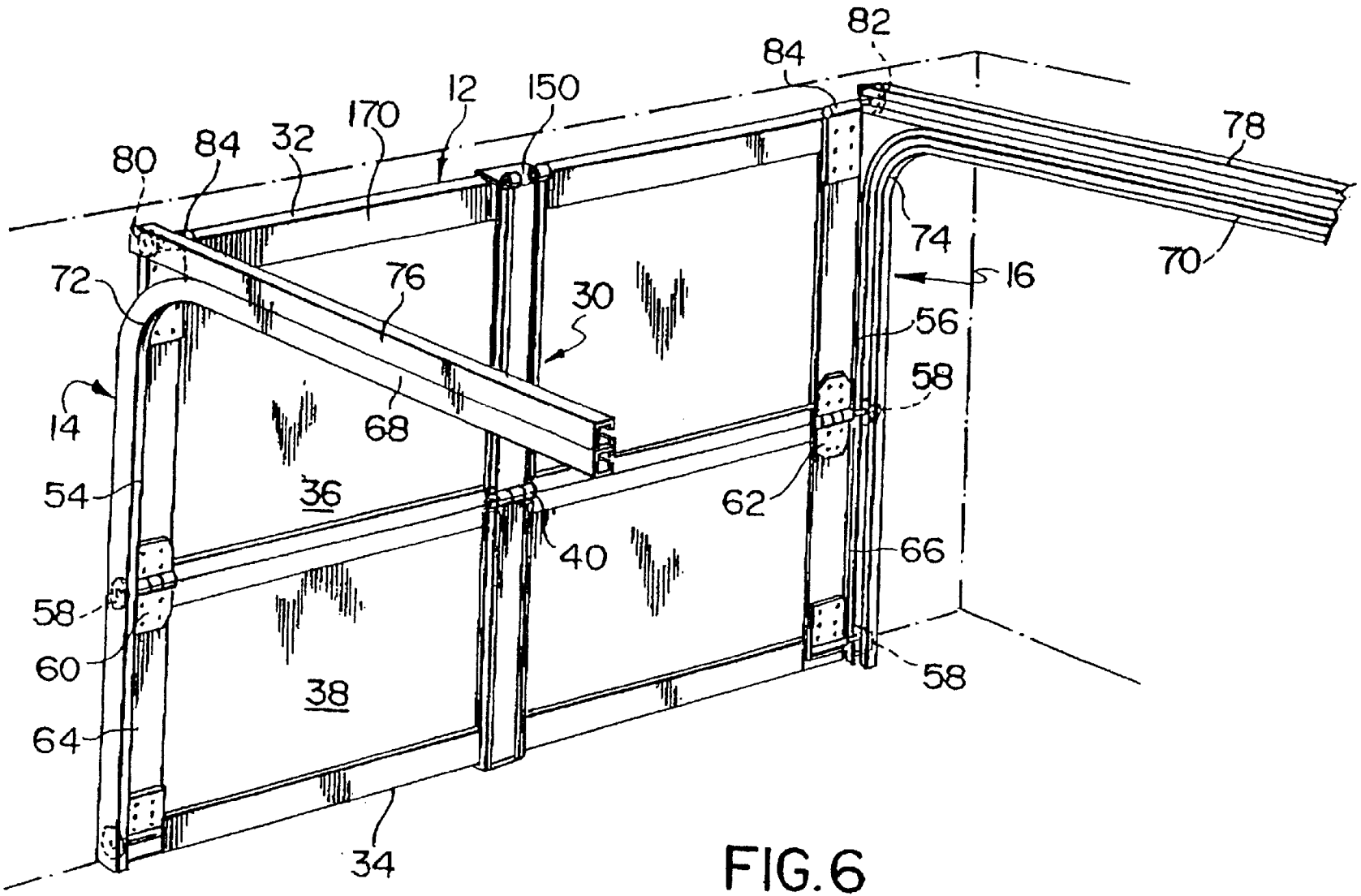
FIG. 6 illustrates a garage door and associated guide rails for the system of FIG. 1.
Figure 7:
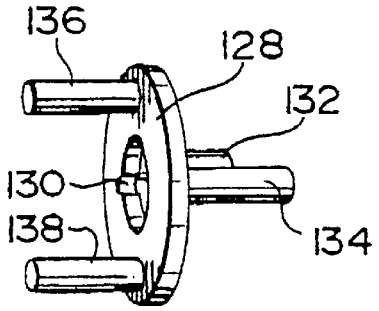
FIG. 7 illustrates a spool lock for use in the system.
Figure 11:
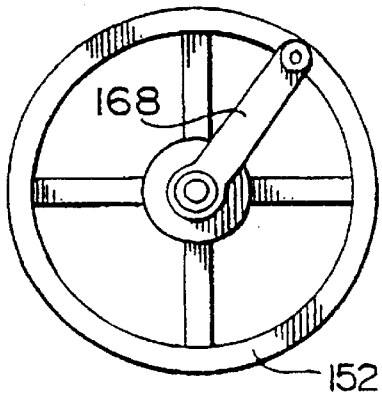
FIG. 11 illustrates a sprocket wheel and crank for use in the invention.
Figure 8:
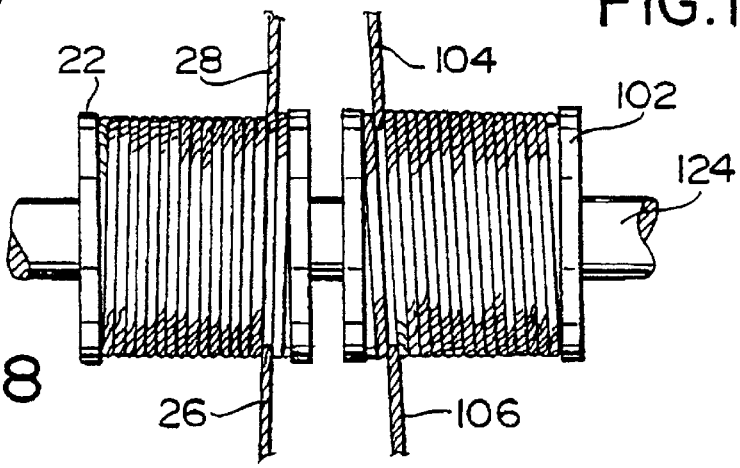
FIG. 8, 9 and 10 illustrate cable drums for use in the system.
Figure 9:
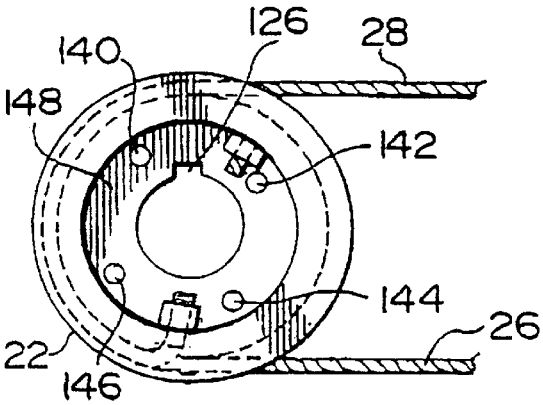
Figure 10:
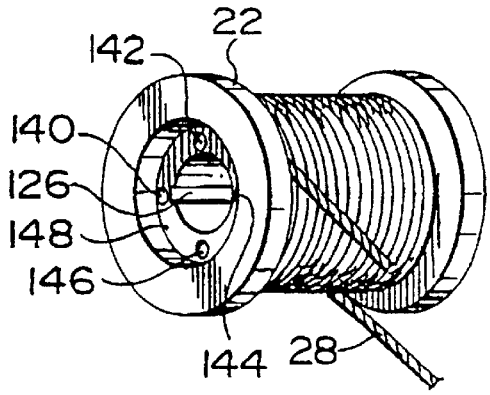
Figure 12:
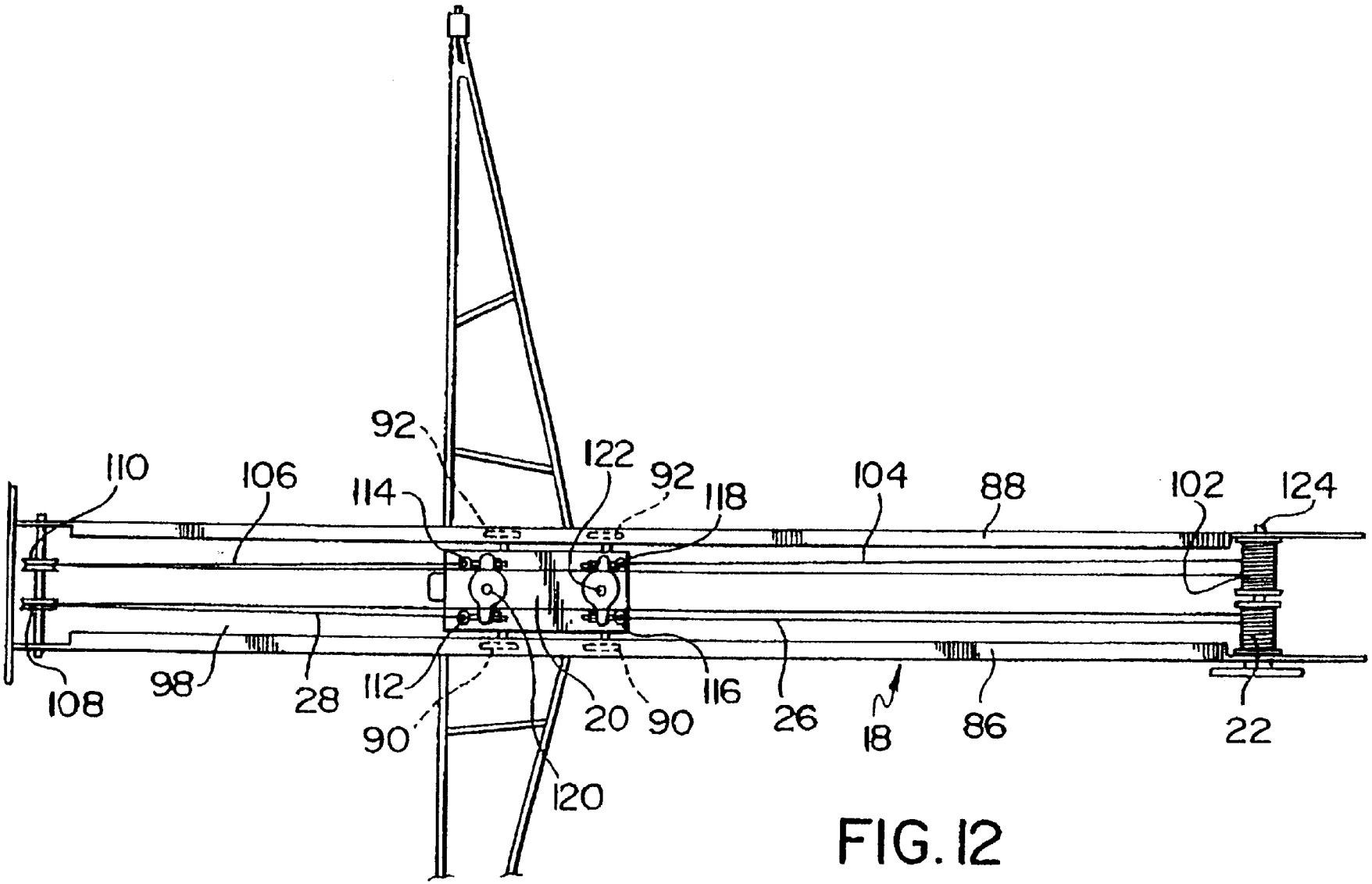
FIG. 12 illustrates a modular assembly for use as part of the system of FIG. 1.

While the invention will be described in conjunction with the illustrated embodiment(s), it will be understood that it is not intended to limit the invention to such embodiment(s). On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The system 10 comprises a number of major component systems including door 12, door rails 14 and 16, central guide rail 18, trolley 20 running in guide rail 18, at least one cable drum 22, an operator system 24 for driving drum 22, and cables 26 and 28 wound on drum 22 for driving trolley 20.

Door 12 includes a central hinge 30 which preferably extends from top 32 to bottom 34 of door 12. In the preferred case door 12 comprises first and second panels 36 and 38 which are hinged and hinge 30 thus includes a midpoint hinge 40. Hinge 30 includes a bracket 42 at top 44 and bracket 46 at bottom 48. Brackets 42 and 46 fit onto top 32 and bottom 34 of door 12.

Hinge member 50 at top 44 of hinge 30 mates with a hinge member 52 on trolley 20.

At first and second sides 54 and 56 of door 12, a series of rollers 58 are provided to run in door rails 14 and 16.

Door hinges 60 and 62 are provided on sides 54 and 56 of door 12 to enable panels 36 and 38 to rotate relative to each other.

Door rails 14 and 16 comprise respectively lower part 64 and 66, upper part 68 and 70, and curved intermediate parts 72 and 74. When the door is raised or lowered, the rollers 58 thus follow the rails 14 and 16 upwardly and downwardly respectively.

In the preferred case a second pair of door rails 76 and 78 are provided above rails 14 and 16 respectively. Door 12 is then provided with a pair of top rollers 80 and 82 which run in rails 76 and 78 respectively. Rails 76 and 78 extend back from a point 84 just above or adjacent the top 32 of door 12. The panel 36 of door 12 can then be drawn straight back at its top 32, so that very little clearance is required above the door. If the top 32 of door 12 moved in the conventional curved rail such as 14 and 16, substantially more headroom would be required, since the curved part 72 and 74 of door rails 14 and 16 would then be required to extend upwardly from the top of the door. The use of the second door rail 76 and 78 to accommodate the top of the door thus permit the headroom to be very significantly reduced.

The central guide rail 18 extends from a position above the top 44 of hinge 30. The trolley 20 runs in central guide rail 18. Guide rail 18 preferably consists of two J-shaped tracks 86 and 88. Roller pairs 90 and 92 on trolley 20 then run respectively in the curved parts 94 and 96 of J-shaped tracks 86 and 88. The space 98 between tracks 86 and 88 permits the hinge member 52 to extend downwardly. Tracks 86 and 88 are positioned such that the hinge members 50 and 52 on hinge 30 and trolley 20 respectively mate to permit hinge pin 100 to be inserted to join hinge 30 to trolley 20.

In order to distribute stress more evenly across the door, a truss 35 may be provided and which is fixed to trolley 20 and is hingedly connected across the top 32 of door 12.

The system preferably includes, in addition to cable drum 22, a second cable drum 102, and a second pair of cables 104 and 106.

A pair of pulleys 108 and 110 are positioned at an end of guide rail 18. Cables 26 and 104 respectively run from drums 22 and 102 over pulleys 108 and 110 and back to connecting points 112 and 114 on pulley 20. Cables 28 and 106 run directly from drums 22 and 102 to connecting points 116 and 118 on the other end of trolley 20.

The cables are double wound on the cable drums so that rotation of the drums will result in first ones of the cable pairs being taken up while second ones are unwound.

Connecting points 112 and 114 and 116 and 118 are preferably connected through pivot points 120 and 122 to allow some self-adjustment of the cables.

The cable drums 22 and 102 are preferably mounted on shaft 124 by means of a keyed connection. Preferably a keyway 126 is provided in the cable drums and a matching keyway is provided in the shaft. A key is then inserted between the drum keyway and the shaft keyway to lock the drum in place.

In the preferred embodiment a spool lock 128 is provided which includes keyway 130 which is also keyed to shaft 124. The lock members 132, 134, 136 and 138 mate with respective lock holes 140, 142, 144 and 146 in the drum hubs 148. Two said members engage two holes in each of the two spools 22 and 102. This ensures that the two spools turn at exactly the same rate, so that the associated cables are always balanced. Lock rings (not shown) may be provided to prevent lateral movement of the spool lock and hence of the cable drums.

Figure 13:
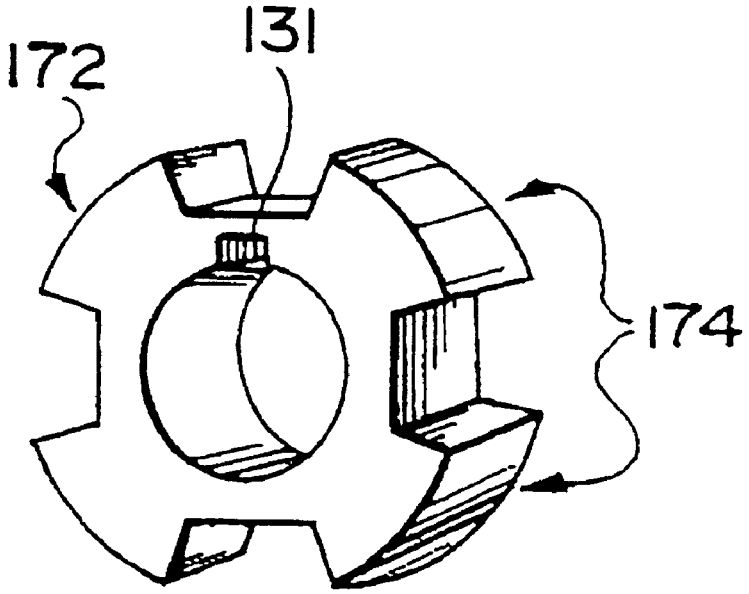
FIG. 13 is an alternative form of spool lock for use in the invention.
Figure 14:
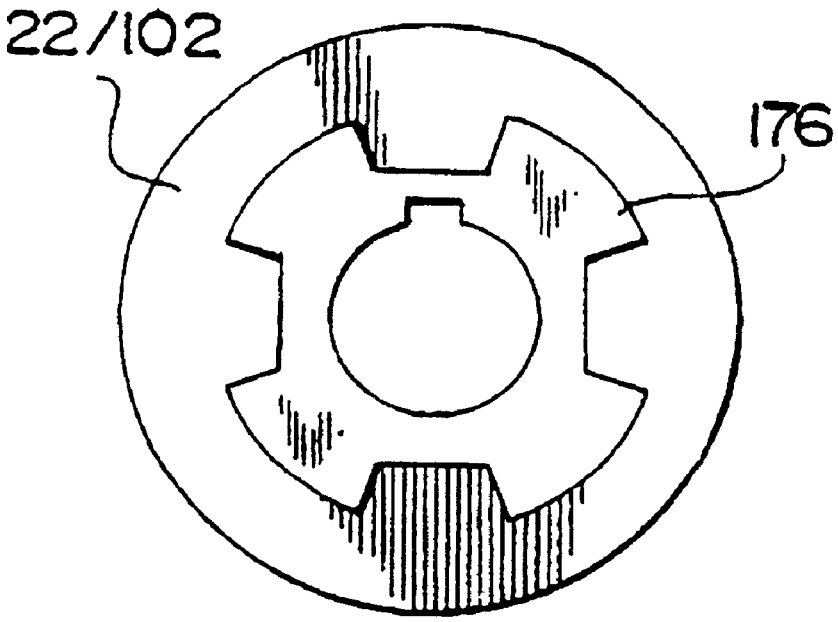
FIG. 14 is an end elevation of a cable drum for use with the spool lock of FIG. 13.

An alternative spool lock arrangement is illustrated in FIGS. 13 and 14. Spool lock 172 includes keyway 131 to mate with a key and keyway on shaft 124. The profiled periphery 174 of lock 172 mates with complementary recesses 176 in the cable drums 22 and 102. This again ensures that the drums rotate at precisely the same rate to thereby balance the force on the cables.

The operator means preferably comprises 150 which is connected through shaft 124 to drive drums 22 and 102. In the preferred configuration the motor operates through a gear reduction system comprising a first sprocket 152 mounted on a shaft 154 and driven by motor shaft 156 via belts 158. Shaft 154 in turn contains a second sprocket 160. A third sprocket 162 is located on shaft 124. The second sprocket 160 drives third sprocket 162 and hence shaft 124 via chain 164.

In the preferred configuration, the central guide rail 18, trolley 20, drums 22 and 102 and their associated cables are constructed as a modular unit.

The sprocket 152 is provided with a manual crank 168 to allow the door to be operated in the event of a power failure. The gear reduction as between sprocket 152 and the cable drums is such as to allow the manual crank to be used without difficulty when necessary.

In operation the energizing of the motor will cause the cable drums to rotate in one direction or the other and the trolley 20 to move accordingly.

In opening the door, trolley 20 picks up the door via the hinge 30. Hinge 30 spreads the stress over the entirety of the door. Of note, there is clearly no bowing effect at the ends of the door.

In the preferred embodiment a lightweight door is utilized which comprises an aluminum frame 170 and in which panels 36 and 38 are of polycarbonate.

Thus, it is apparent that there has been provided in accordance with the invention a garage door opening/closing system that fully satisfies the objects, aims and advantages set forth above. While the invention has been described in conjunction with (a) specific embodiment(s) thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows:

1. A combination of a garage door and an opening/closing system for said door, comprising:

a garage door having top, bottom, and first and second sides and having a series of rollers associated with said first and second sides;

a pair of door rails at said first and second sides of said door for receiving said rollers for movement of said door along said rails in a door opening path;

a central guide rail extending outwardly from the plane of a closed position of said door from a position above the top of said door;

a powered trolley mounted on said central guide for movement along said guide rail;

at least one member for hinged connection between said door and said trolley, said member comprising a hinge member extending from a mid-point of said top of said door, and comprising at least one bracket covering a whole height of the door from top to bottom.

2. The combination of claim 1 wherein said door comprises at least two hinged sections and wherein said at least one member for hinged connection comprises one said bracket extending over each of said sections and wherein adjacent ones of said brackets are hingedly connected to each other.

3. The combination of claim 1 wherein said at least one member for hinged connection includes a bracket connected over said top of said door.

4. The combination of claim 1 wherein said at least one member for hinged connection Includes a bracket connected under said bottom of said door.

5. The combination of claim 1 wherein said at least one member for hinged connection is connected directly to a hinge part on said trolley.

6. The combination of claim 1 wherein said powered trolley is driven by a cable drive which comprises two cable drums, each having a pair of cables oppositely wound thereon at one end and connected to said trolley at the other end and wherein one said cable of each pair passes over a pulley at a remote end of said guide rail and is connected to an end of said trolley remote from said drum.

7. The combination of claim 6 wherein said drums are mounted on a common shaft.

8. The combination of claim 7 wherein said drums are mounted on said shaft by keying said drums to said shaft.

9. The combination of claim 6 further comprising a motor for driving said cable drive.

10. The combination of claim 1 wherein said door comprises a lightweight metal frame and lightweight non-metal panels.

11. The combination of claim 10 wherein said frame is aluminum.

12. The combination of claim 10 wherein said panels are single thickness non-laminated polycarbonate.

13. The combination of claim 1, including a pair of upper door rails which extend from positions adjacent said top of said door on said first and second sides thereof, and above and substantially parallel to an upper part of said door rails, and wherein said door includes an upper pair of rollers for movement in said upper door rails.

* * * * *